US005705985A

United States Patent [19]

Studach

[11] Patent Number: 5,705,985

[45] Date of Patent: Jan. 6, 1998

[54] STRUCTURE-BORNE SOUND DETECTOR FOR BREAK-IN SURVEILLANCE

[75] Inventor: Cornel Studach, Hombrechtikon, Switzerland

[73] Assignee: Cerberus AG, Mannedorf, Switzerland

[21] Appl. No.: 600,365

[22] Filed: Feb. 13, 1996

[30] Foreign Application Priority Data

Feb. 13, 1995 [EP] European Pat. Off. ..... 95101937

[51] Int. Cl.[6] ..... G08B 13/00

[52] U.S. Cl. ..... 340/566; 367/901; 381/71; 381/94

[58] Field of Search ..... 340/566; 367/901; 381/71, 94

[56] References Cited

U.S. PATENT DOCUMENTS 4,290,058 9/1981 Bystricky ..... 340/566
4,306,228 12/1981 Meyer ..... 340/566

FOREIGN PATENT DOCUMENTS 2 560 701 9/1985 France .
2 569 027 2/1986 France .

*Primary Examiner*—Glen Swann
*Attorney, Agent, or Firm*—Burns, Doane, Swecker & Mathis, LLP

[57] ABSTRACT

A structure-bone sound detector suppresses unwanted signals in a frequency range to be monitored, to enhance the immunity of the detector to false alarms. The output signal from a sound sensor undergoes preprocessing, and is then fed to a pair of comb filters that are connected in parallel. The comb filters have mirror image filtering characteristics. The filtered output signals from the two comb filters are provided to a minimum value stage, which selects the smaller of the two output signals. This selected signal is further processed to detect an alarm condition. With this arrangement, broad band signals of interest will produce approximately the same outputs from each of the two comb filters, and therefore be passed on for further processing. In contrast, a narrow band interference signal will be suppressed by one of the two comb filters, and therefore not selected for further processing.

14 Claims, 2 Drawing Sheets

STRUCTURE-BORNE SOUND DETECTOR FOR BREAK-IN SURVEILLANCE

FIELD OF THE INVENTION

The invention relates to a structure-borne sound detector for the surveillance of safes, strong boxes, strong rooms and automatic cash-dispensing machines. Such detectors have a sensor connected to the object to be kept under surveillance for picking up structure-borne sound and have an electronic evaluation system which is connected to the sensor. An amplified sensor signal is mixed with a carrier frequency and the mixed signals are filtered in a narrow frequency range.

BACKGROUND OF THE INVENTION

Such detectors are sometimes called noise detectors. They serve to detect attacks on protective objects made of steel or concrete and on strong boxes having plastic-reinforced protective coatings. The operation of the structure-borne sound or noise detectors is based on the fact that, when hard materials, such as, for example, concrete or metal, are machined, mass accelerations occur and, as a result, mechanical vibrations are generated which propagate in the material as structure-borne sound. The sensor, preferably a piezoelectric sensor, picks up such vibrations and converts them into electrical signals. The detector electronics analyze the signals and, in the event of an appropriate result, trigger an alarm.

As with all automatic surveillance devices, it is also very important in the case of structure-borne sound detectors that false alarms are avoided if possible. That is to say, unwanted signals should be suppressed. In the structure-borne sound detector described in U.S. Pat. No. 4,290,058, the unwanted signals are essentially suppressed by mixing the vibrations picked up by the sensor with a carrier frequency which periodically and continuously traverses a certain frequency range and by filtering the mixed signals in a narrow-band frequency range.

Although the electronic evaluation system of this known structure-borne sound detector has the advantage that the evaluated frequency band is much more sharply delineated than if a band-pass filter were used alone, a disturbing signal situated inside the evaluated frequency band can still, of course, trigger a false alarm. In this connection, the structure-borne sound vibrations generated in a break-in attempt are situated in a characteristic frequency range, chiefly in the kHz range near the upper limit of audibility between about 12 and 20 kHz, whereas typical interfering noises are of substantially lower frequency or even of higher frequency. Experience shows that in the frequency range which is characteristic of structure-borne sound vibrations in a break-in attempt, vibrations which persist for a fairly long time repeatedly occur, with the result that false alarms are triggered.

SUMMARY OF THE INVENTION

The present invention is intended to provide an electronic evaluation system for a structure-borne sound detector with which unwanted signals situated inside the known frequency range are suppressed. Consequently, the reliability and false alarm immunity of suitably equipped structure-borne sound detectors are decisively improved.

According to the invention, the electronic evaluation system has a comb-filter circuit which comprises two comb filters which are arranged in parallel and are of mirror-image construction. Their outputs are fed to a minimum stage from which only the smaller of the output signals of the two comb filters is supplied for further processing.

In a preferred exemplary embodiment of the structure-borne sound detector according to the invention, each comb filter has a filter period of not more than 500 Hz. Preferably, the filter period is 200 Hz.

A normal attack signal or break-in signal is relatively broad-band and will deliver an approximately equally large signal to the outputs of the two comb filters of the comb-filter circuit, so that it is immaterial which of the two signals is processed further. The smaller signal will only be insignificantly smaller than the greater signal and will therefore trigger an alarm equally as rapidly and equally as certainly as the latter. If, however, a relatively narrow-band unwanted radiation occurs in the frequency band under consideration, such unwanted radiation will certainly be transmitted by one comb filter because of the short filter period and not by the other, with the result that the occurrence of a certain difference between the output signals of the two comb filters is an indication of a disturbance signal. If, therefore, only the respectively smaller of the two signals is processed further, as is proposed according to the invention, the unwanted radiation is automatically suppressed and does not need to be analyzed in greater detail.

However, practical experience has shown that an unexpectedly large amount of unwanted radiation has occurred, especially more recently, in the narrow frequency range between 12 and 20 kHz. It can be presumed with some certainty that such unwanted radiation is caused by electronic equipment, for example by switched-mode power supplies or by viewing-screen devices mounted on the object to be kept under surveillance. Higher-frequency unwanted radiation in the frequency range of about 25 kHz may be caused, for example, by ultrasonic intrusion detectors.

BRIEF DESCRIPTION OF THE DRAWINGS

The invention is explained in greater detail below by reference to an exemplary embodiment and the drawings; in the drawings.

DETAILED DESCRIPTION OF PREFERRED EMBODIMENTS

Figure 1:
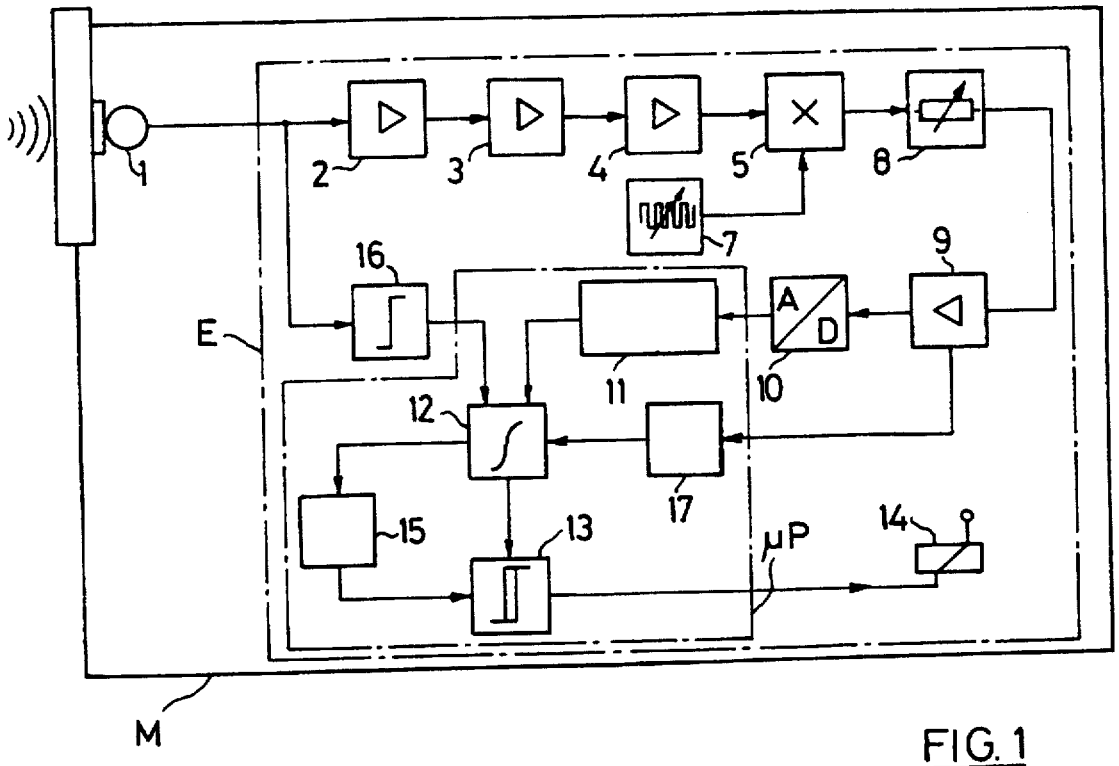
FIG. 1 shows a block diagram of a structure-borne sound detector according to the invention having a comb-filter circuit.

The structure-borne sound detector M shown in FIG. 1 contains a microphone 1, which acts as structure-borne sound pick-up, and an electronic evaluation system E. The microphone serves to pick up the vibrations generated by mass accelerations during the machining of hard materials and to convert such vibrations into electrical signals. An electronic evaluation system is disclosed in U.S. Pat. No. 4,290,058 and such are known also from the structure-borne sound detectors of the types GM31, GM35 and GM36 of Cerberus AG and will only be described briefly here. As regards the microphone 1, reference is made to Swiss Patent Application No. 0 172/94 of Cerberus AG.

The output signal of the microphone 1 is fed via an impedance converter 2 to a preamplifier 3. The preamplified signal is fed via a further amplifier 4 to a mixer 5, where the amplified signal is mixed with the signal of an oscillator 7. The signal mixing product is fed via a sensitivity controller 8 to an intermediate-frequency amplifier 9, which also contains a low-pass filter. The amplified IF signal is fed to an A/D converter 10 and from the latter into a comb-filter circuit 11 whose output signal is fed to an integrator 12, in which a numerical integration of the output signal of the comb-filter circuit 11 is performed. As soon as the value at the integrator 12 exceeds the threshold of an alarm comparator 13, an alarm is triggered by the release of an alarm relay 14.

The alarm comparator is wired as a Schmitt trigger. In this connection, the switching thresholds are chosen so that, in the event of an alarm by the integrator 12, the alarm self-holding time is set to approximately 1 s by means of a timer 15. In the event of strong blows or in the event of an explosion, a flip-flop 16 is triggered which charges the integrator 12 in a very short time and effects an alarm triggering. If the time interval between two consecutive noises is greater than approximately 5 to 10 s, the integrator 12 is rapidly discharged by a stage 17. The operations of comb-filter circuit 11, integrator 12, alarm comparator 13 and stage 17 are implemented in a programmed microprocessor μP.

Figure 2:
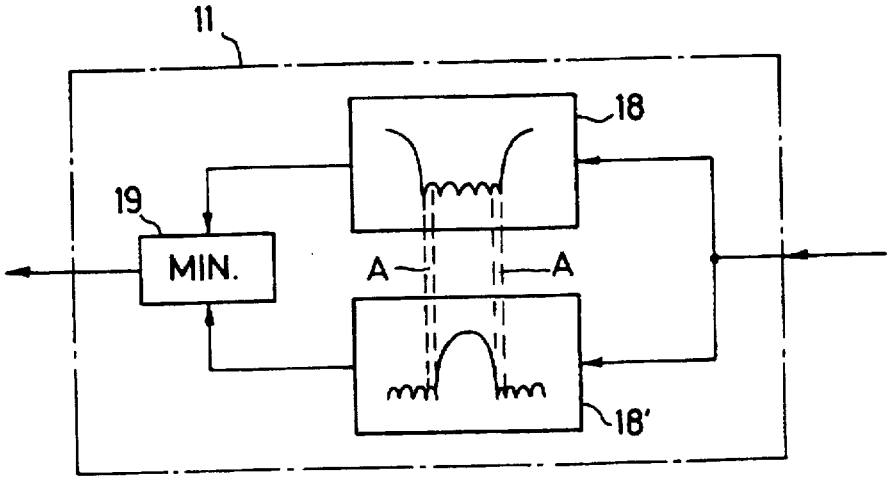
FIG. 2 shows a diagram of the comb-filter circuit of FIG. 1.

FIG. 2 shows a somewhat more detailed diagram of the comb-filter circuit 11 of FIG. 1. According to the diagram, said comb-filter circuit 11 comprises two comb filters 18 and 18' which are arranged in parallel and are of mirror-image construction and whose outputs are fed to a minimum stage 19, from which only the respectively smaller of the output signals of the comb filters 18, 18' is relayed to the integrator 12 (FIG. 1) and the greater signal is suppressed. A comb filter is, as is known, a filter having a periodic frequency response in which pass bands and stop bands mutually alternate. Comb filters are used, for example, in the video signal processing in the colour decoder of television sets (in this connection, see, for example: H. Schönfelder, "Bildkommunikation" ("Video communication"), pages 188f, Springer-Verlag,. Berlin, Heidelberg, N.Y., 1983). The mirror-image construction of the two comb filters 18, 18' means that where there are stop bands in the case of one filter, there are pass bands in the case of the other filter, and vice versa. And that has the consequence that a narrow-band signal occurring inside a frequency band having a band width corresponding to half the filter period is transmitted by one of the two comb filters 18 or 18' and is not transmitted or at least strongly suppressed by the other.

Figure 3:
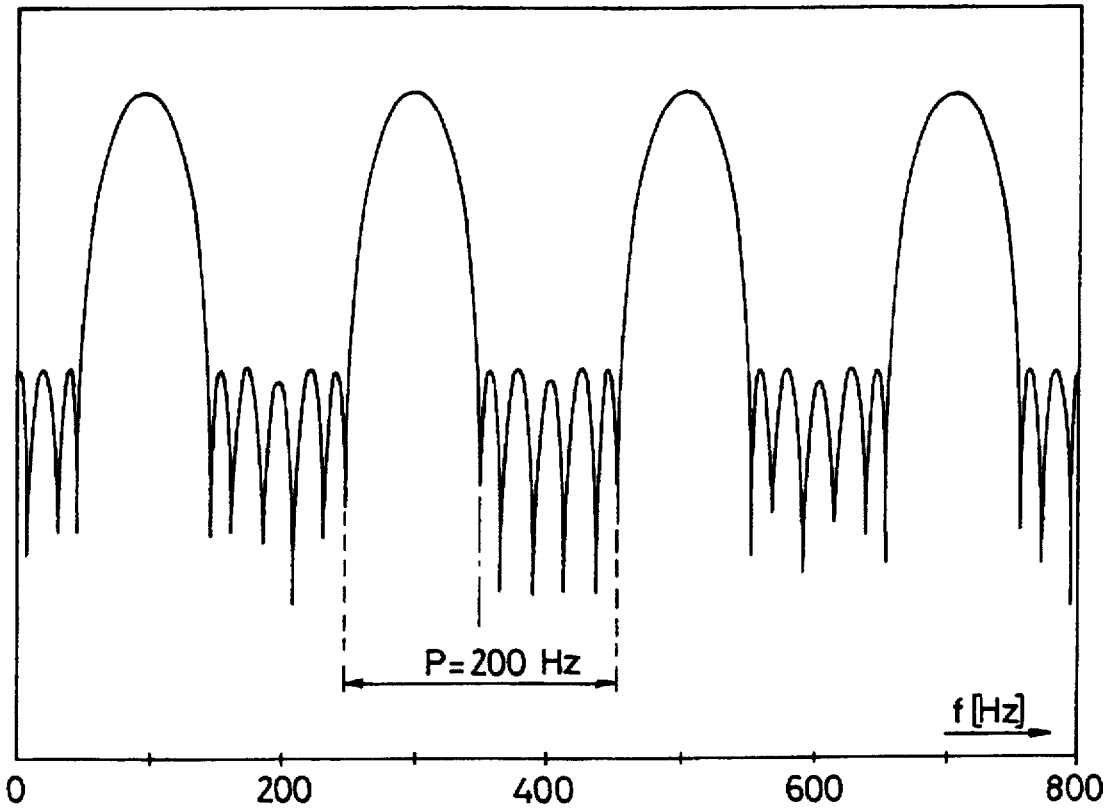
FIG. 3 shows the transfer characteristic of a comb filter of the circuit of FIG. 2.

FIG. 3 shows the transfer characteristic of one of the two comb filters 18, 18' over a frequency range of 800 Hz. As is mentioned in the introduction to the description, the typical structure-borne sound vibrations generated in a break-in attempt are in a frequency range between 12 and 20 kHz. This frequency range is mixed down in the electronic evaluation system E to a band between 0 and 4 kHz, over which band the transmission range of the two comb filters 18, 18' also extends. According to the diagram, the comb filters are each transmissive for a frequency band of 100 Hz width and are not transmissive for an equally wide frequency band. The filter period P is 200 Hz and each of the two comb filters 18, 18' has respectively 20 stop bands and pass bands, the latter being mutually shifted by half a filter period in the two filters.

Figure 4:
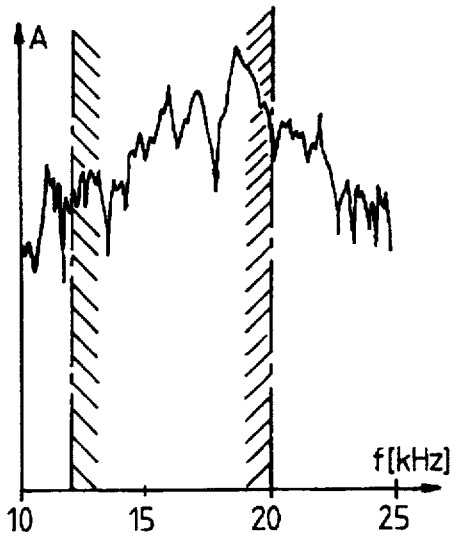
FIG. 4 shows the frequency spectrum of a normal attack signal or break-in signal.
Figure 5:
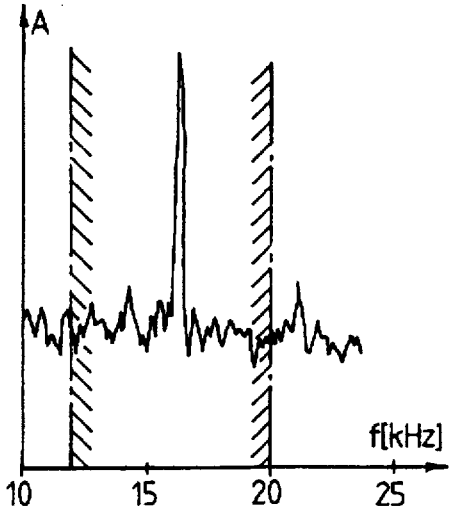
FIG. 5 shows the frequency spectrum of an unwanted signal.

FIGS. 4 and 5 show the frequency spectra of a normal attack signal or break-in signal (FIG. 4) and of an unwanted signal (FIG. 5), respectively, the signal variation being shown over a frequency range of 10–25 kHz and the frequency range between 12 and 20 Hz of interest in the case of structure-borne sound detectors being highlighted by two chain-dot lines with a hatching.

The normal attack signal or break-in signal shown in FIG. 4 is so wide-band that the output signals of the two comb filters 18, 18' (FIG. 2) are always approximately equally great so that it is not important which of the two output signals is processed further in deciding whether there is a break-in attempt or an attack attempt and an alarm should be triggered.

In the case of the unwanted signal of FIG. 5, the conditions are different: here two components can be seen which make up the signal shown: on the one hand, a relatively small and steady basic signal in which all the frequencies in the range under consideration are represented approximately equally and, on the other hand, a marked, very narrow unwanted signal at approximately 16 kHz. Said unwanted signal is so narrow that, with high probability, it is transmitted only by one of the two comb filters 18 or 18' and is stopped by the other. Since the filter which stops the unwanted signal provides the smaller output signal, the unwanted signal is consequently not taken into account in the further processing.

The comb filters are dimensioned so that, in the great majority of all cases, the unwanted signal is suppressed by one of the two filters 18 or 18'. So that even unwanted signals which are situated precisely in the transition range A (FIG. 2) between the pass band and the stop band of the comb filters are reliably suppressed, the two comb filters 18, 18' are designed so that the stop band is always somewhat wider than the pass band, with the result that both filters do not transmit in transition range A and, consequently, any unwanted signal is suppressed by both filters 18 and 18'.

As has already been mentioned, the comb-filter stage 11 is implemented in the microprocessor μP and specifically, either as an FIR (=finite impulse response) filter or as an IIR (=infinite impulse response) filter.

What is claimed is:

1. Structure-borne sound detector for the surveillance of safes, strong boxes, strong rooms and automatic cash-dispensing machines, having a sensor connected to the object to be kept under surveillance for picking up structure-borne sound, and having an electronic evaluation system which is connected to the sensor and in which the amplified sensor signal is mixed with a carrier frequency and the mixed signals are filtered in a narrow frequency range, wherein the electronic evaluation circuit has a comb-filter circuit which comprises two comb filters which are arranged in parallel and are of mirror-image construction and whose outputs are fed to a minimum value stage from which the respectively smaller of the output signals of the two comb filters is supplied for further processing.

2. Structure-borne sound detector according to claim 1, wherein each comb filter has a filter period of not more than 500 Hz.

3. Structure-borne sound detector according to claim 2, wherein the filter period is 200 Hz.

4. Structure-borne sound detector according to claim 3, wherein the stop bands and pass bands of the two comb filters are mutually shifted by half a filter period.

5. Structure-borne sound detector according to claim 1, wherein the pass bands of the two comb filters are narrower than the stop bands with the result that both comb filters simultaneously do not transmit in the transition ranges between pass band and stop band.

6. Structure-borne sound detector according to claim 1, wherein the electronic evaluation system contains a microprocessor and the comb filters are implemented in said microprocessor.

7. Structure-borne sound detector according to claim 6, wherein the comb-filter circuit is implemented in the microprocessor as an FIR filter.

8. Structure-borne sound detector according to claim 6, wherein the comb-filter circuit is implemented in the microprocessor as an IIR filter.

9. A structure-borne sound detector, comprising:

a sensor for producing a signal corresponding to detected sounds;

a mixer for mixing said signal with a carrier frequency;

a pair of comb filters connected in parallel to receive the mixed signal, said comb filters having mirror-image filtering characteristics for producing respective output signals;

a minimum value stage for selecting the smaller of the two respective output signals from the comb filters; and an alarm circuit for processing the selected output signal to detect an alarm condition.

10. The structure-borne sound detector of claim 9, wherein each of said comb filters has a filter period which is no greater than 500 Hz.

11. The structure-borne sound detector of claim 9, wherein said comb filters have respective stop bands and pass bands that are mutually shifted by one-half of a filter period.

12. The structure-borne sound detector of claim 11, wherein the pass bands of each filter are narrower than the corresponding stop bands of the other filter.

13. The structure-borne sound detector of claim 9, wherein said comb filters are implemented as FIR filters.

14. The structure-borne sound detector of claim 9, wherein said comb filters are implemented as IIR filters.

* * * * *